US010107316B2

(12) United States Patent
Yoavaphankul

(10) Patent No.: US 10,107,316 B2
(45) Date of Patent: Oct. 23, 2018

(54) APPARATUS FOR CREATING A SWIRLING FLOW OF FLUID ON HORIZONTAL PLANE

(71) Applicant: Luxnara Yaovaphankul, Bangkok (TH)

(72) Inventor: Metha Yoavaphankul, Bangkok (TH)

(73) Assignee: Luxnara Yaovaphankul, Bangkok (TH)

( * ) Notice: Subject to any disclaimer, the term of this patent is extended or adjusted under 35 U.S.C. 154(b) by 0 days.

(21) Appl. No.: 15/537,097

(22) PCT Filed: Dec. 8, 2015

(86) PCT No.: PCT/TH2015/000088
§ 371 (c)(1),
(2) Date: Jun. 16, 2017

(87) PCT Pub. No.: WO2016/099407
PCT Pub. Date: Jun. 23, 2016

(65) Prior Publication Data

US 2018/0128293 A1 May 10, 2018

(30) Foreign Application Priority Data

Dec. 18, 2014 (TH) ..... 1401007573

(51) Int. Cl.
*F15C 1/16* (2006.01)
*F15D 1/00* (2006.01)

(52) U.S. Cl.
CPC ..... *F15D 1/0015* (2013.01)

(58) Field of Classification Search
CPC ..... F15D 1/0015; F15D 1/003; F15D 1/004; F15D 1/0045; F15D 1/009
USPC ..... 137/808, 803, 809, 810, 811, 812
See application file for complete search history.

(56) References Cited

U.S. PATENT DOCUMENTS 3,447,383 A * 6/1969 Camarata ..... G01C 19/14 137/809
3,546,854 A * 12/1970 Muller ..... B01D 47/00 210/512.1

(Continued)

FOREIGN PATENT DOCUMENTS

| | | |
|---|---|---|
| CN | 1370255 | 9/2002 |
| WO | 2011009166 | 1/2011 |
| WO | 201404988 | 1/2014 |

OTHER PUBLICATIONS

International Search Report for Application No. PCT/TH2015/000088 dated Apr. 20, 2016.

(Continued)

*Primary Examiner* — Minh Le
(74) *Attorney, Agent, or Firm* — Kim Winston LLP

(57) ABSTRACT

An apparatus for creating a swirling flow of fluid on horizontal plane comprises of transmission base (1) for creating of swirling which is in cone shape with minimal slope or round and flat base with thickness. It comprise of swirling flow creating surface (2) located symmetrically around central apex or center of transmission base (1) to create swirling flow. In between swirling creating surface (2), there is at least one penetrable slit (3) along the edge of swirling flow creating surface (2) for transmission fluid from one side of transmission base (1) to anther side to swirling flow creating surface (2) to creating swirling on the horizontal plane of apparatus. The said apparatus is installed inside the structure that needed to create swirling on horizontal plane.

7 Claims, 15 Drawing Sheets

(56) References Cited

U.S. PATENT DOCUMENTS

| | | | | |
|---|---|---|---|---|
| 3,563,260 | A * | 2/1971 | Ellis | F15C 1/16 137/810 |
| 3,885,931 | A | 5/1975 | Schaller | |
| 4,695,225 | A * | 9/1987 | Hellat | F15D 1/0015 239/486 |
| 4,885,089 | A * | 12/1989 | Hankammer | B01D 29/90 137/803 |
| 5,070,972 | A * | 12/1991 | Dourson | F16F 9/3214 137/808 |
| 6,244,817 | B1 | 6/2001 | Ngo | |
| 7,267,098 | B1 | 9/2007 | Tasanont | |
| 7,805,932 | B2 * | 10/2010 | Oxborrow | B01F 5/0616 60/324 |
| 8,220,444 | B2 * | 7/2012 | Cheung | F02M 29/06 123/306 |
| 2002/0110047 | A1 | 8/2002 | Bruck et al. | |
| 2012/0167991 | A1 * | 7/2012 | Feilner | B01D 19/0057 137/1 |
| 2014/0102572 | A1 * | 4/2014 | Ryon | F15D 1/08 137/808 |
| 2014/0165578 | A1 * | 6/2014 | Burd | F02G 3/00 60/772 |
| 2015/0136261 | A1 * | 5/2015 | Yoavaphankul | F15D 1/0015 137/812 |

OTHER PUBLICATIONS

Written Opinion for Application No. PCT/TH2015/000088 dated Apr. 20, 2016.

* cited by examiner

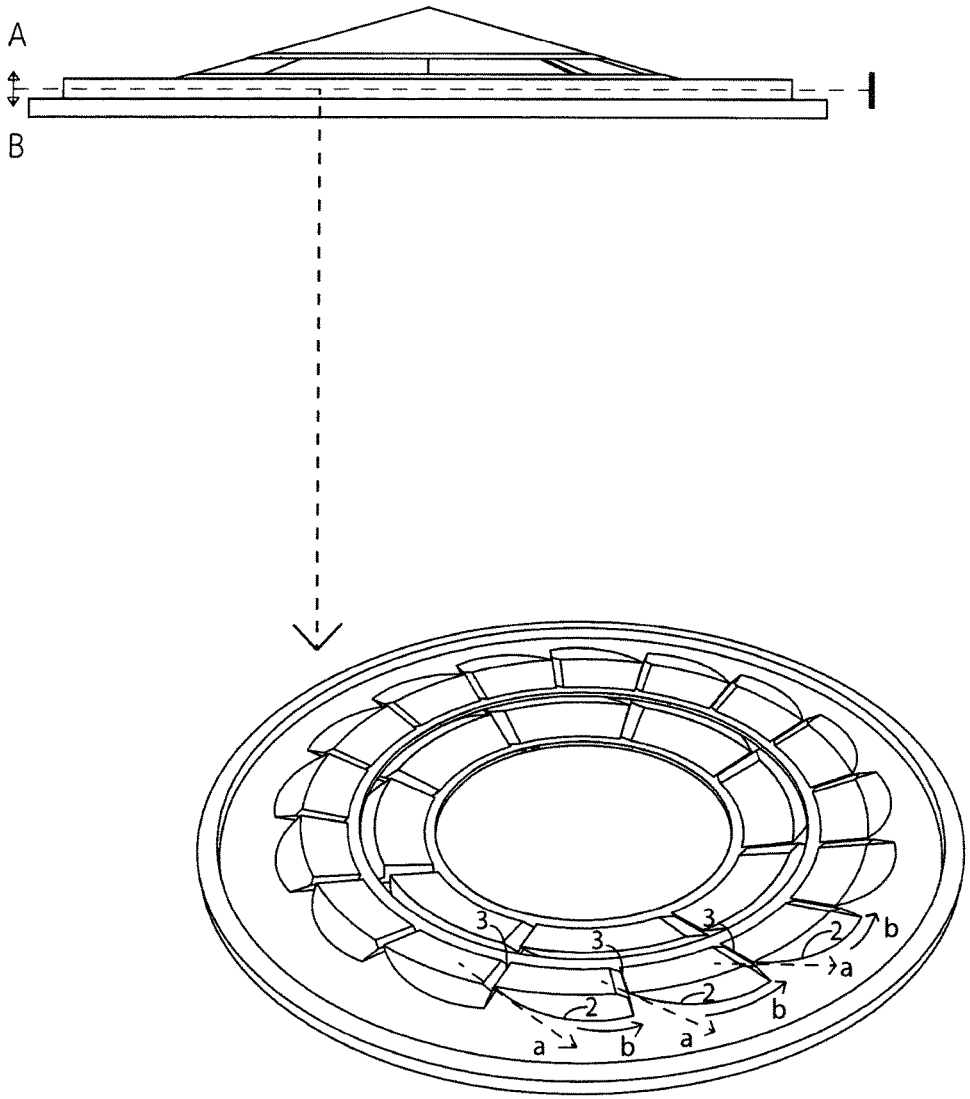
Fig.1D (section A)

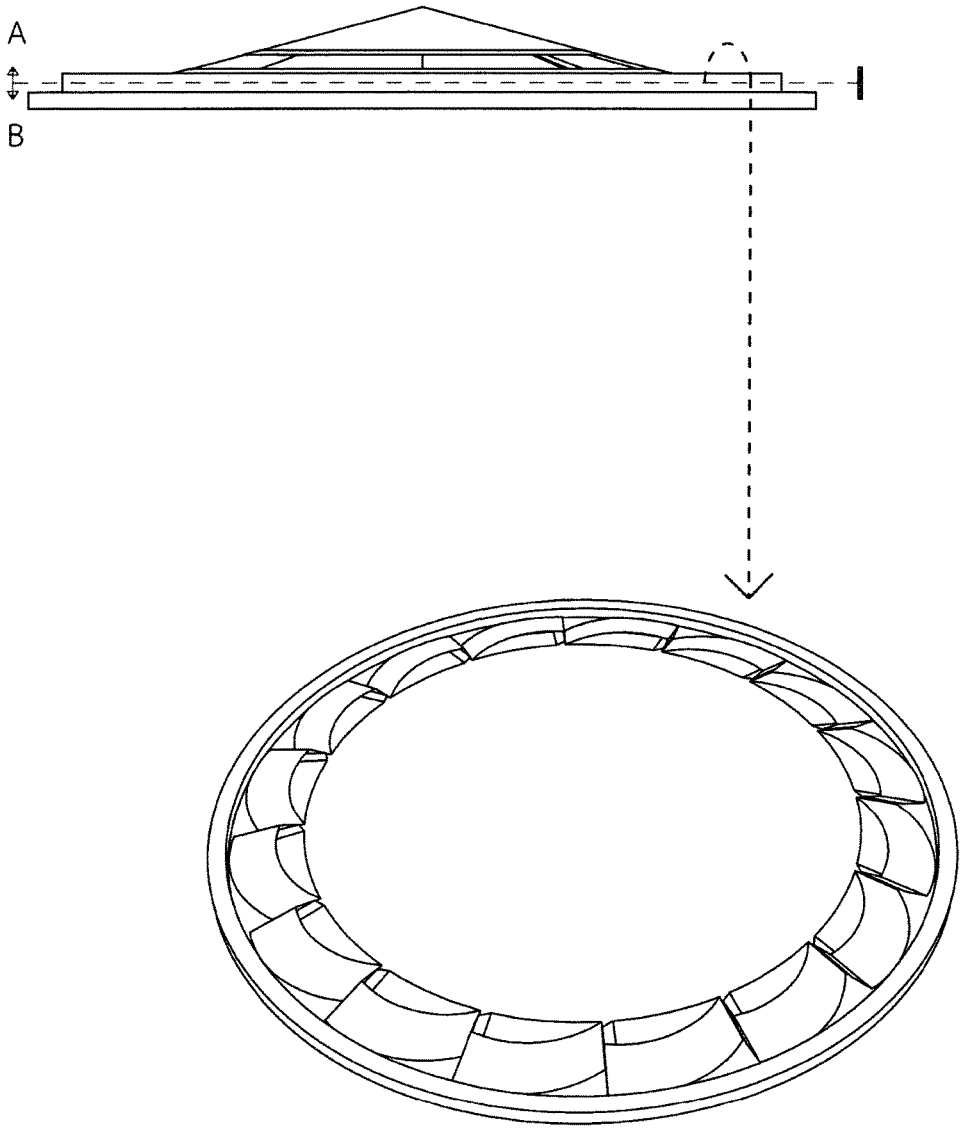
Fig.1E (section B)

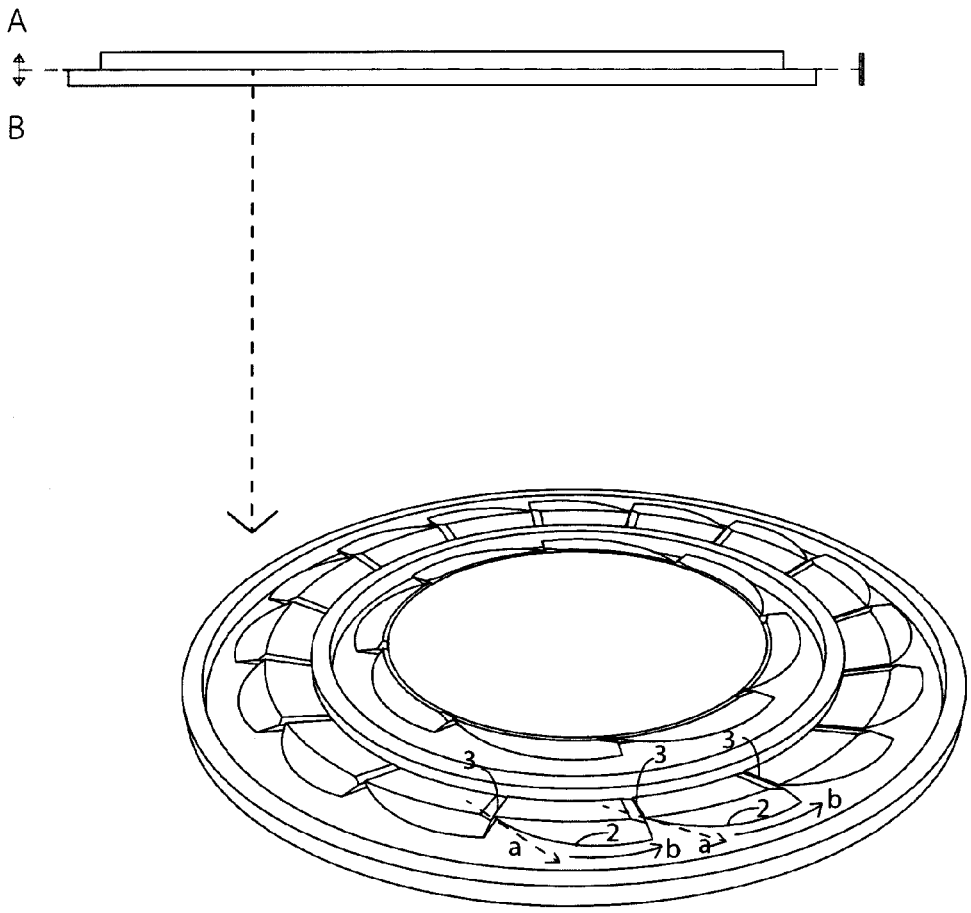
Fig. 2D (section A)

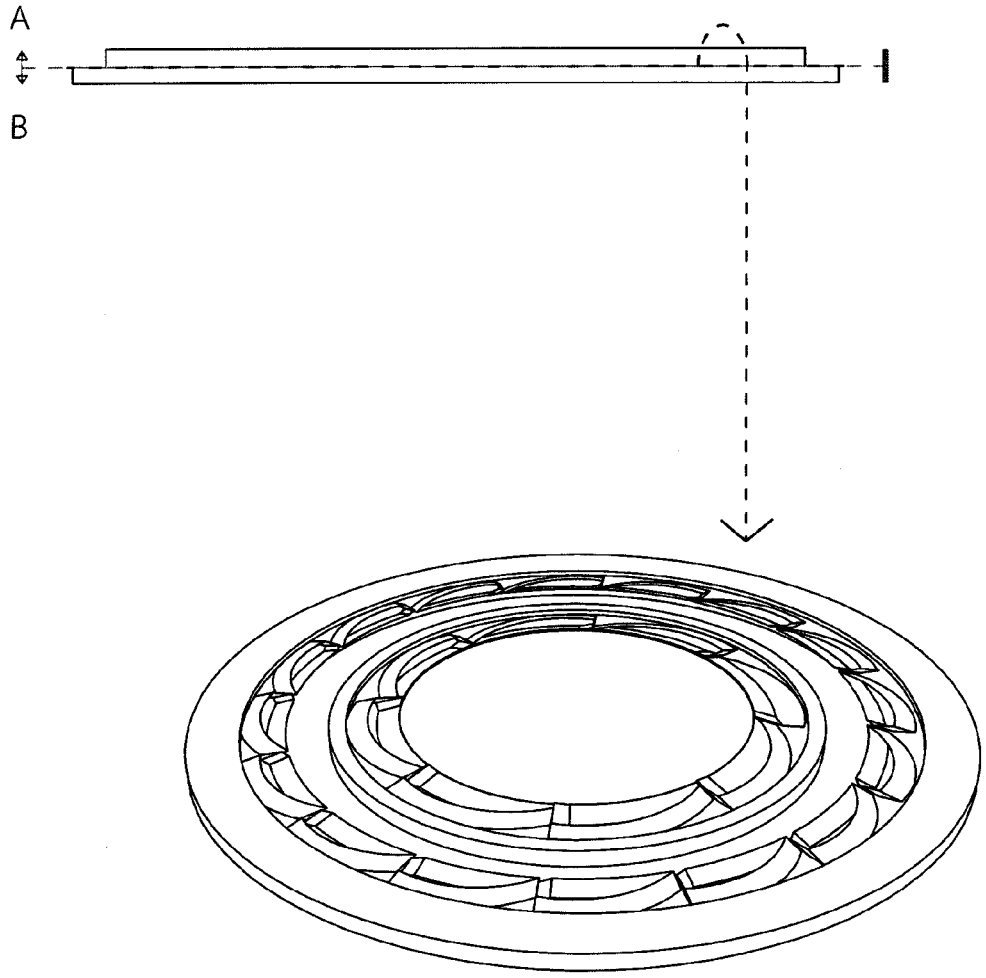
Fig. 2E (section B)

APPARATUS FOR CREATING A SWIRLING FLOW OF FLUID ON HORIZONTAL PLANE

CROSS-REFERENCE TO RELATED APPLICATIONS

This application is a national phase application under 35 U.S.C. § 371 of International Application No. PCT/TH2015/000088 filed Dec. 8, 2015, which claims priority to Thailand Patent Application No. 1401007573 dated Dec. 18, 2014, the entire disclosures of which are hereby incorporated by reference in their entirety.

TECHNICAL FIELD

Engineering related to apparatus for creating a swirling flow of fluid on horizontal plane.

BACKGROUND OF ARTS

Referring to Thai Patent number 41173 "Apparatus for creating a swirling flow of fluid," an apparatus that creates swirling flow of fluid is disclosed. The apparatus comprises a transmission base with an internal cavity configured to receive the fluid flow from outside via a side penetrable hole where a hole side edge is formed to direct the fluid into transmission base. The beginning of the hole side edge has to be the surface with a smallest angle of deviation of the emerging axis of the penetrable hole. A section having a convex curve of the hole side edge has to be the nearest surface to an emerging axis of the side penetrable hole, when compared with other surfaces surrounding the emerging axis to deflect the flow of incoming fluid to flow attaching to the convex curve. It will induce the fluid in the internal cavity of transmission base to flow attaching to the convex curve and create a laminar swirling flow of fluid in the transmission base.

The creation of swirling flows by the apparatus for creating a swirling flow of fluid of Patent number 41173 as said is the creation of swirling flows that flows of fluid attaching along with inner surface of cylindrical transmission base by the Coanda effect. The present invention is different in, at least, that the creation of laminar swirling flows on the horizontal plane.

CHARACTERISTICS AND PURPOSE OF THIS INVENTION

An apparatus for creating a swirling flow of fluid on horizontal plane characterized in that said apparatus comprises of transmission base which is a circular base in cone shape with very low incline angle. The surface of cone shape that slope to the central apex of circular base is the swirling flow creating surface, which is located symmetrically on the surface contour of cone shape. In between swirling flow creating surfaces, there is at least one penetrable slit along the edge of swirling flow creating surface for transmission fluid from underpart of transmission base through penetrable slit to the upper part of transmission base to create the swirling flow on the horizontal plane. Swirling flow creating surface is curved outward to the circumferential surface contour of cone shape of which beginning section of swirling flow creating surface has to be the surface with a smallest angle of deviation of the emerging axis of the penetrable slit. It is also the surface that is nearest to emerging axis when compared with other surface surround the emerging axis. Fluid with a certain pressure is forced to flow through penetrable slit, injecting upon transmission base to be deflected and induce fluid on transmission base to flow along the current of fluid on the swirling flow creating surface, which is the area that is difficult to flow through and induce fluid to flow attaching to swirling flow creating surface the swirling flow creating surface is in set of surfaces designed to induce fluid to flow around center of transmission base that means to induce swirling flow of fluid on the horizontal plane of transmission base which is in cone shape with a minimal slope and minimal incline angle that is close to horizontal plane.

An apparatus for creating a swirling flow of fluid on horizontal plane characterized in that said apparatus comprises of transmission base which is round and flat base with a certain thickness which the swirling flow creating surface is the surface around cone shape with minimal slope to the central apex of transmission base which the surface of cone shape is vertically cut down in part to be rearranged horizontally and symmetrically surround the central apex of transmission base to reduce the height of transmission base to be close to horizontal plane. In between swirling flow creating surfaces there is at least one penetrable slit along the edge of swirling flow creating surface for transmission fluid from underpart of transmission base to the upper part of transmission base. Swirling flow creating surface is curved outward to the circumferential surface contour of cone shape. Of which beginning section of swirling flow creating surface has to be the surface with smallest angle of deviation of the emerging axis of penetrable slit. It is also the surface that is nearest to emerging axis when compared with other surface surround emerging axis. Fluid with a certain pressure is forced to penetrate through penetrable slit, injecting upon transmission base to be deflected and induce fluid on transmission base to flow along the current of fluid on the swirling flow creating surface, which is the area that is difficult to flow through and induce fluid to flow attaching to swirling flow creating surface. The swirling flow creating surface, which is set of surfaces that is designed to induce fluid to flow around center of transmission base. It means to induce swirling flow of fluid on the horizontal plane of transmission base which is round at flat base.

An apparatus for creating a swirling flow of fluid on horizontal plane characterized in that said apparatus comprises of transmission base which is round and flat base with a certain thickness. Of which swirling flow creating surface is located around center of transmission base. In between swirling flow creating surface, there is at least one penetrable slit along the edge of swirling flow creating surface for transmission fluid from underpart of transmission base through penetrable slit to the upper part of transmission base to create the swirling flow on the horizontal plane. Swirling flow creating surface is twisted as concentric spiral to the center of transmission base of which the beginning section of twisting swirling flow creating surface has to be the surface with smallest angel of deviation of the emerging axis of the penetrable slit. It is also the surface that is nearest to emerging axis when compared with other surface surround the emerging axis. Fluid with a certain pressure is forced to penetrate through penetrable slit, injecting upon transmission base to be deflected and induce fluid on transmission base to flow along the current of fluid on the swirling creation surface, which is the area that is difficult to flow through and induce fluid to flow attaching to swirling creating surface the swirling flow creating surface of which its surface is twisted as concentric spiral to the center of transmission base for inducing swirling fluid on the plane of transmission base. It means creating swirling flow of fluid on horizontal plane of transmission base which is round and flat.

An apparatus for creating a swirling flow of fluid on a horizontal plane comprising a transmission base having a circular base; a plurality of swirling flow creating surfaces located symmetrically circumscribing a central axis of the transmission base, wherein each of the plurality of swirling flow creating surfaces is curved outward to a circumferential surface contour of a cone shape, a conical frustum shape, or a concentric spiral shape about the central axis of the transmission base; and a penetrable slit in between a pair of adjacent swirling flow creating surfaces along an edge of one of the pair of adjacent swirling flow creating surfaces for transmitting fluid from an underpart of the transmission base through the penetrable slit to an upper part of the transmission base to create the swirling flow of fluid on the horizontal plane, wherein a beginning section of an individual swirling flow creating surface is nearest an axis of emergence of fluid through the penetrable slit when compare with other surface surround the penetrable slit such that the plurality of swirling flow creating surfaces creates a Coanda effect to deflect and induce fluid to flow attaching to the swirling flow creating surfaces creating the swirling flow on the horizontal plane of the transmission base.

An aspect of the apparatus is that the transmission base is a cone shape or a conical frustum shape which has an incline slope of about 10-15 degrees. Each of the plurality of penetrable slits extends along an entire side length of one of the plurality of flow creating surfaces. The plurality of swirling flow creating surfaces circumscribing the central axis of the transmission base forms a first row of swirling flow creating surfaces, and wherein the apparatus further includes a second row of swirling flow creating surfaces adjacent the first row of swirling flow creating surfaces and so on for the additional rows. The transmission base is an annular base supporting the plurality of swirling flow creating surfaces, and wherein the annular base includes one of an annular wall or a conical wall circumscribing the plurality of swirling flow creating surfaces.

An apparatus for creating a swirling flow of fluid on a horizontal plane comprising a transmission base having a circular base; a plurality of swirling flow creating surfaces located symmetrically circumscribing a central axis of the transmission base, wherein each of the plurality of swirling flow creating surfaces is curved outward to a circumferential surface contour of a cone shape, a frustum shape, or a concentric spiral shape about the central axis of the transmission base having a round and flat base with a thickness; and a penetrable slit in between a pair of adjacent swirling flow creating surfaces along an edge of one of the pair of adjacent swirling flow creating surfaces for transmitting fluid from an underpart of the transmission base through the penetrable slit to an upper part of the transmission base to create the swirling flow of fluid on the horizontal plane, wherein a beginning section of an individual swirling flow creating surface is nearest an emerging portion of a longitudinal axis of through the penetrable slit such that the plurality of swirling flow creating surfaces creates a Coanda effect to deflect and induce fluid to flow creating surfaces creating the swirling flow on the horizontal plane.

An aspect of the apparatus is that the transmission base has an incline slope of about 10-15 degrees. Each of the plurality of penetrable slits extends along an entire side length of one of the plurality of flow creating surfaces. The plurality of swirling flow creating surfaces circumscribing the central axis of the transmission base forms a first row of swirling flow creating surfaces, and wherein the apparatus further includes a second row of swirling flow creating surfaces adjacent the first row of swirling flow creating surfaces. The transmission base is an annular base supporting the plurality of swirling flow creating surfaces, and wherein the annular base includes one of an annular wall and a conical wall circumscribing the plurality of swirling flow creating surfaces.

An apparatus for creating a swirling flow of fluid on horizontal plane according to this invention comprises a transmission base for creating swirling flow. The transmission base structure is a cone shape with a minimal incline angle or a round flat base with a certain thickness. There are the swirling flow creating surfaces located symmetrically around a center of the transmission base. In between sets of surfaces for creating swirling flow, there is at least one slit along the edge of surfaces for creating swirling flow. The slit transmits fluid from one side to the other side of the transmission base to the surfaces for creating swirling flow which is located on the plane of the said apparatus. The said apparatus for creating a swirling flow of fluid on horizontal plane is set inside the structure in which it is designed for creating swirling flow. There are 3 kinds of contour surface for creating swirling flow of fluid. These include: a cone contour design with a minimal incline angle to a central apex as surface for creating swirling flow; a horizontal rearrangement of fractional cone contour design; and a concentric spiral contour design to be the surface for creating swirling flow of fluid.

The purpose of this invention is to have an apparatus for creating a swirling flow of fluid on a horizontal plane by the principle of the Coanda effect to deflect and induce fluid to create laminar swirling flow on the horizontal plane that could be installed inside the structure that needs to create swirling flow.

Additionally, the purpose of this invention is to also have an apparatus for creating a swirling flow of fluid on the horizontal plane, by which boundary layer that flows along with the horizontal plane is flow as fluid sheet in the manner of a Laminar swirling flow with high velocity without turbulent flow. It also has a clear distribution of layers of centrifugal acceleration gradient clearly.

BRIEF DESCRIPTION OF DRAWINGS

FIG. 1D, shows a horizontal section view from bottom of the apparatus for creating a swirling flow of fluid on the horizontal plane of the cone contour design with the minimal incline angle to central apex as surface to create swirling flow.

FIG. 1E, shows a horizontal section view from top of the apparatus for creating a swirling flow of fluid on the horizontal plane of the cone contour design with the minimal angle to central apex as surface to create swirling flow.

FIG. 2D, shows a horizontal section view from bottom a of the apparatus for creating a swirling flow of fluid on the horizontal plane of the type of horizontal rearrangement of the fractional cone contour design as the surface for creating swirling flow.

FIG. 2E, shows a horizontal section view from a top of the apparatus for creating a swirling flow of fluid on the horizontal plane of the type of horizontal rearrangement of the fractional cone contour design as the surface for creating swirling flow.

DISCLOSURE OF INVENTION

According to FIG. 1A-1F, an apparatus for creating a swirling flow of fluid on a horizontal plane of the present invention comprises of transmission base 1 for creating swirling flow. The base is a circular base having a cone shape with a very low incline angle (shown in FIG. 1C). The suitable incline angle is about 10°-15°. The cone surface is sloped to a central apex where the swirling flow creating surface 2 is located symmetrically. In between swirling flow creating surfaces 2, there is at least one penetrable slit 3 along the edge of the swirling flow creating surface 2 for transmitting fluid from underpart of transmission base 1 through the penetrable slit 3 (shown in FIG. 1B) to an upper part of transmission base 1 to create swirling flow on the horizontal plane.

Swirling flow creating surface 2 is curved outward to the circumferential wall of the cone (shown in FIG. 1D, section A) of which a beginning section of swirling flow creating surface 2 has to be the surface with a smallest angle of deviation of an emerging axis (a) of the penetrable slit 3. It is also the surface that is nearest to emerging axis (a) when compared with other surfaces around the emerging axis (a).

Fluid with a certain pressure is forced to penetrate through the penetrable slit 3 to the upper part of transmission base 1 to be deflected and induce the fluid on transmission base 1 to flow along the swirling flow creating surface 2, which is the area that is difficult to flow through and induce fluid to flow attaching to swirling flow creating surface 2 by swirling flow creating surface 2.

Swirling flow creating surface 2 is a set of surfaces that is designed to flow around a center of the transmission base 1 which is the plane of cone shape with a minimal slope and a minimal incline angle that is close to the horizontal plane.

Figure 1A:
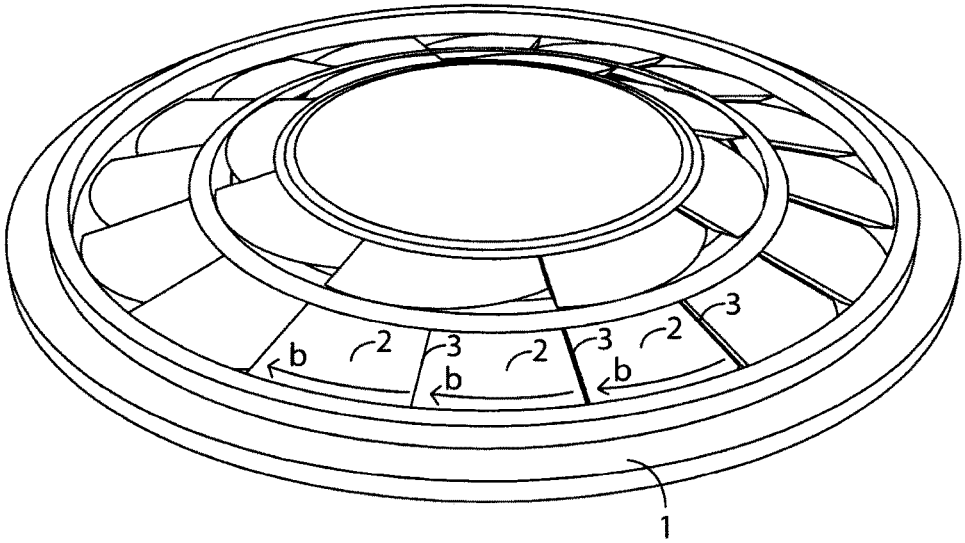
FIG. 1A, shows an apparatus for creating a swirling flow of fluid on a horizontal plane according to this invention which is designed in concept of using cone contour design with a minimal incline angle to a central apex as a surface to create swirling flow.
Figure 1B:
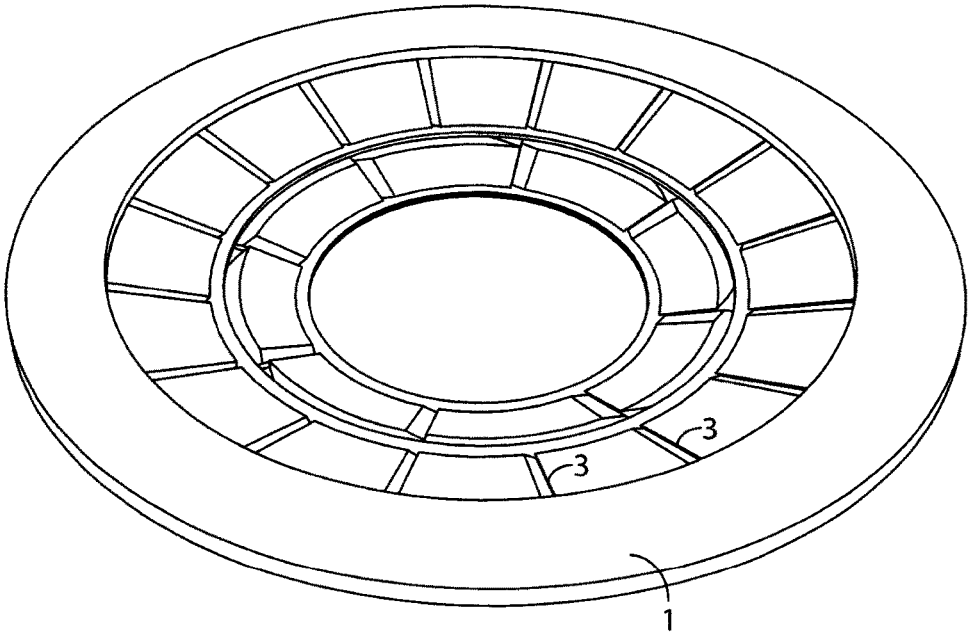
FIG. 1B, shows an underpart of the apparatus for creating a swirling flow of fluid on the horizontal plane of the cone contour design with the minimal incline angle to a central apex as the surface to create swirling flow.
Figure 1C:
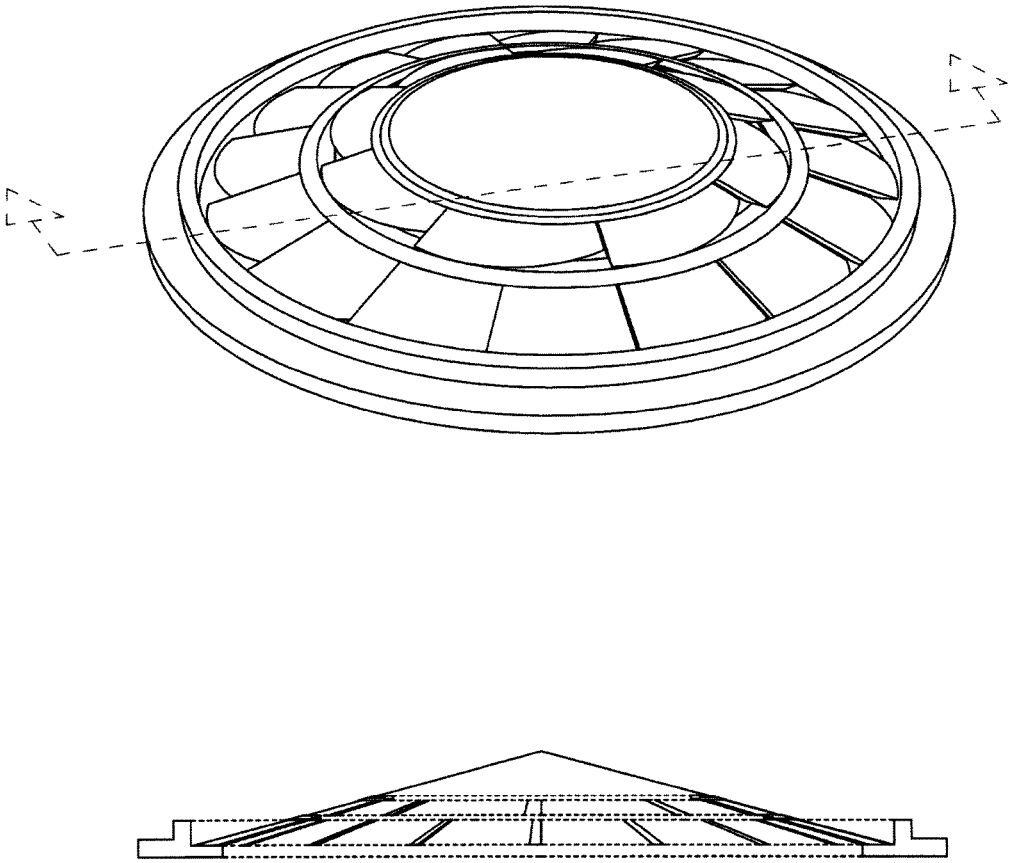
FIG. 1C, shows a vertical section view of the apparatus for creating a swirling flow of fluid on the horizontal plane of the cone contour design with the minimal incline angle to the central apex as surface to create swirling flow.
Figure 1F:
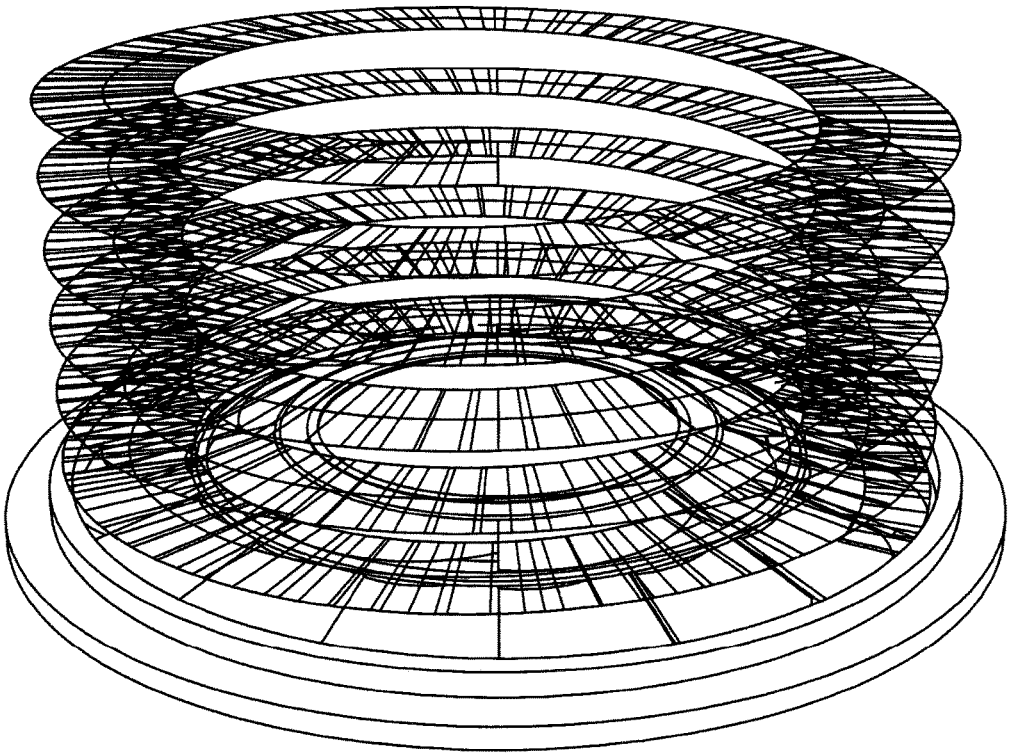
FIG. 1F, shows a swirling laminar flow of fluid in vertical to the horizontal plane of the apparatus for creating a swirling flow of fluid which is a type of cone contour design with a minimal angle to central apex as surface to create swirling flow.
Figure 2A:
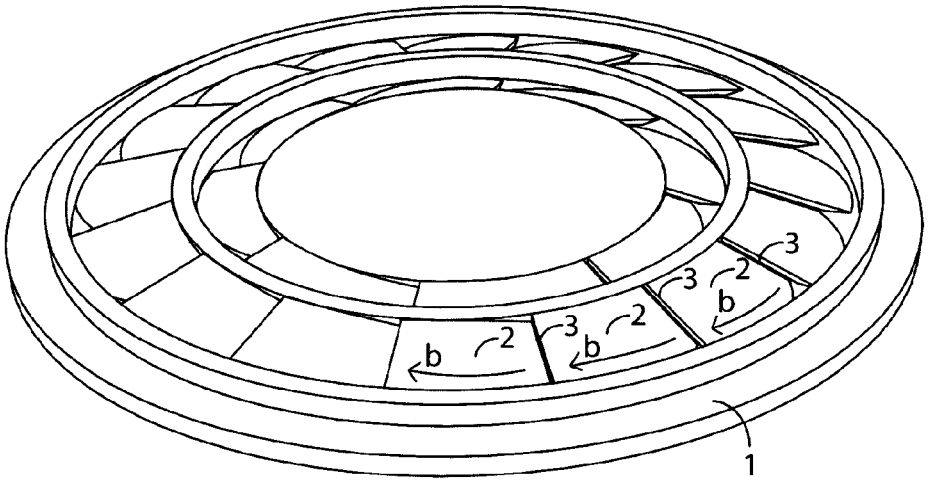
FIG. 2A, shows an apparatus for creating a swirling flow of fluid on a horizontal plane of a type of horizontal rearrangement of a fractional cone contour design as a surface for creating swirling flow.
Figure 2B:
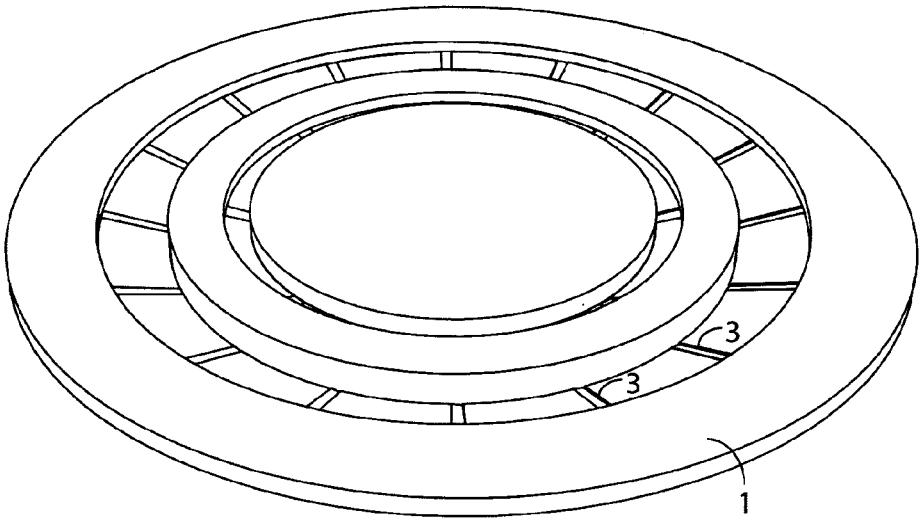
FIG. 2B, shows an underpart of the apparatus for creating a swirling flow of fluid on the horizontal plane of the type of horizontal rearrangement of the fractional cone contour design as the surface for creating swirling flow.
Figure 2C:
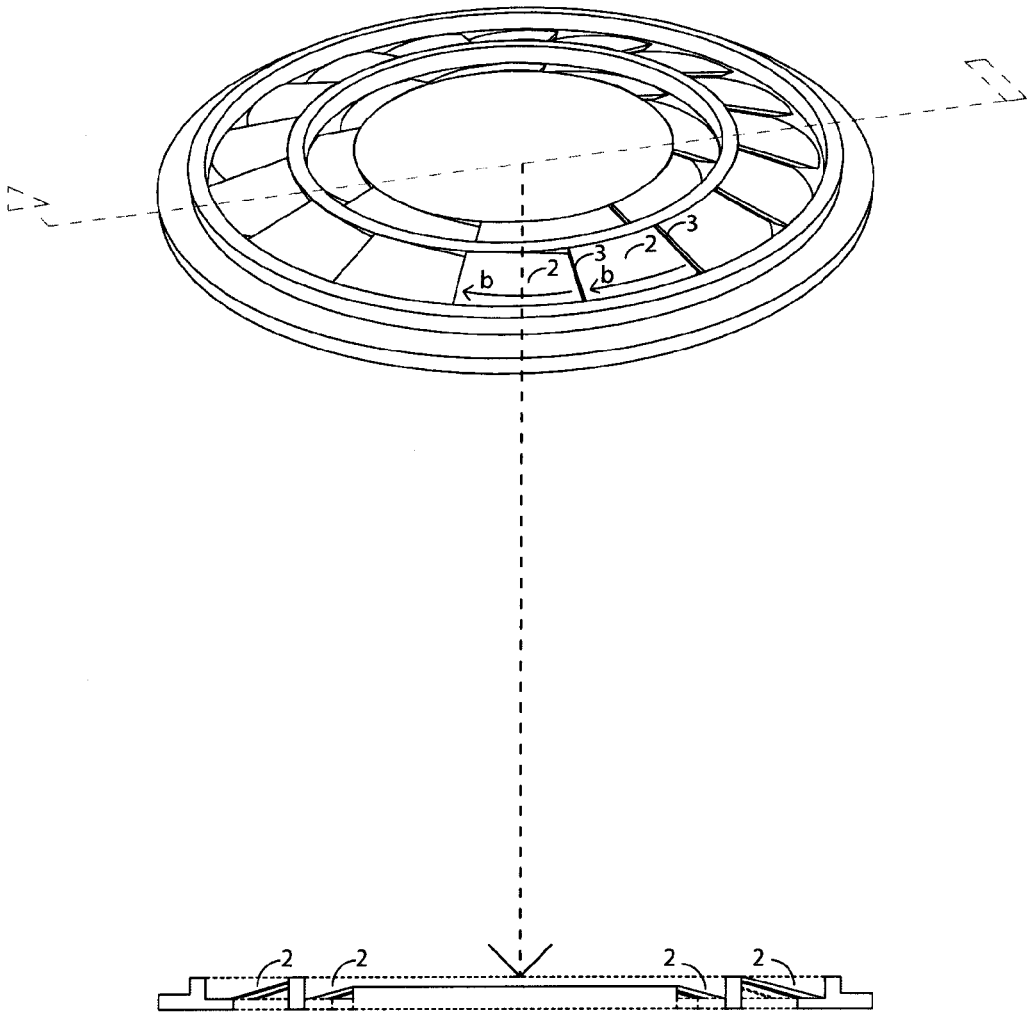
FIG. 2C, shows a vertical section view of the apparatus for creating a swirling flow of fluid on the horizontal plane of the type of horizontal rearrangement of the fractional cone contour design as the surface for creating swirling flow.
Figure 2F:
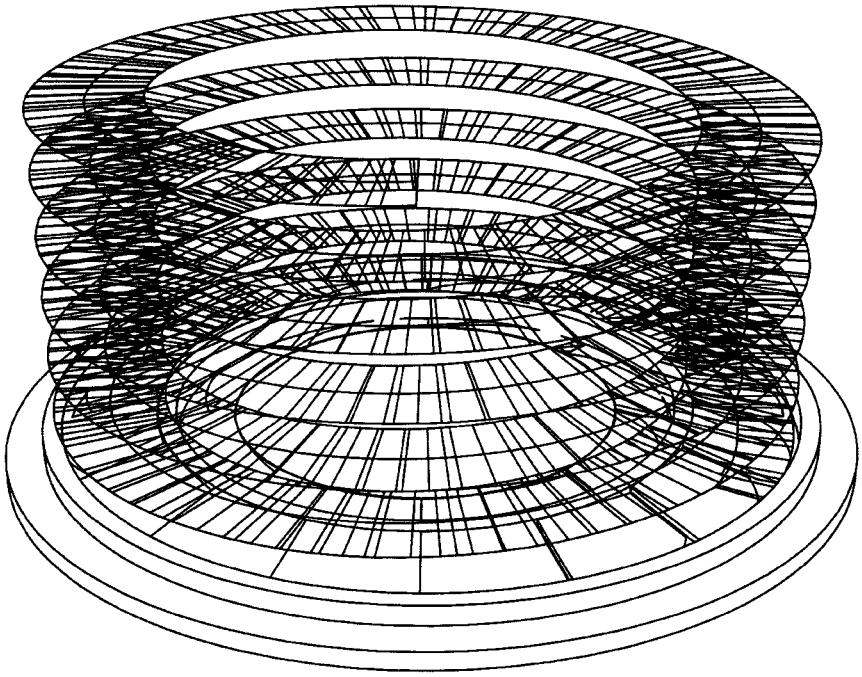
FIG. 2F, shows a Laminar swirling fluid in vertical to the horizontal plane of the apparatus for creating a swirling flow of fluid of the type of horizontal rearrangement of the fractional cone contour design as the surface for creating swirling flow.

The flow of fluid from said profile will create the deflection and induce the fluid upon the transmission base 1 to flow attaching to the swirling flow creating surface 2 which is located around the transmission base 1 (shown in FIGS. 1A and 1D on arrow (b)), which has a minimal slope to the central apex, thus creating swirling flow of fluid on the plane in the manner of fluid sheet in laminar swirling flow with high velocity without turbulent flow and it is swirling on vertical to the horizontal plane (shown in 1F).

According to FIGS. 2A-2F, an apparatus for creating a swirling flow of fluid on a horizontal plane of the present invention comprises a transmission base 1 to create swirling flow. The base is round and flat with a certain thickness (shown in FIG. 2C). The apparatus has a swirling flow creating surface 2 made as a wall cone sloped to the center with a minimal incline angle. The suitable incline angle is about 10°-15° at which point the cone wall to be cut down and rearranged horizontally around center of transmission base 1 to reduce the height of transmission base to configure the transmission base being close to the horizontal plane. The said swirling creation surface 2 is located symmetrically around a center of the transmission base 1. In between swirling creation surfaces 2, there is at least one penetrable slit 3 along the edge of swirling flow creating surface 2 for transmitting fluid from the underpart of the transmission base 1 through the penetrable slit 3 (shown in FIG. 2B) to the upper part of transmission base 1 to create the swirling flow on the horizontal plane.

Swirling flow creating surface 2 is curved outward to the circumferential wall of cone (shown in FIG. 2D, section A) of which a beginning section of the swirling flow creating surface 2 has to be the surface with a smallest angle of deviation of the emerging axis of the penetrable slit 3. It is also the surface that is nearest to the emerging axis (a) when compared with other surface around the emerging axis (a). Fluid with a certain pressure is forced to penetrate through the penetrable slit 3, to the upper part of transmission base 1 to be deflect and to induce fluid on transmission base 1 to flow along the swirling flow creating surface 2, which is the area that is difficult to flow through, and induce fluid to flow attaching to swirling flow creating surface 2 by swirling flow creating surface 2.

Swirling flow creating surface 2 is set of surfaces that is designed to surround a center of transmission base 1 and that induce fluid to flow along the plane of transmission base 1 which is in round and flat shape. The flow of fluid from said profile is creating the deflection and inducing of fluid upon transmission base 1 to flow attaching to swirling flow creating surface 2 that is located surround transmission base 1 (shown in FIGS. 2A and 2D on arrow (b)), which has minimal slope to central apex The flow creates a swirling flow of fluid on a plane in the manner of fluid sheet in laminar swirling flow with high velocity without turbulent flow and it is swirling on vertical to the horizontal plane (shown in 2F).

According to FIG. 3A-3F, an apparatus for creating a swirling flow of fluid on a horizontal plane of the present invention comprises a transmission base 1 to create swirling flow of fluid on the horizontal plane. The base is round and flat with a certain thickness (shown in FIG. 3E). Swirling flow creating surfaces 2 (shown in FIG. 3C) are located symmetrically around a center of the transmission base 1. In between swirling flow creating surfaces 2, there is at least one penetrable slit 3, along the edge of swirling flow creating surface 2 for transmitting fluid from underpart of transmission base 1 through the penetrable slit 3 (shown in FIG. 3D) to the upper part of the transmission base 1 to create the swirling flow on the horizontal plane.

The swirling flow creating surface 2 (shown in FIG. 3C) is twisted as a concentric spiral to the center of transmission base 1. The beginning section of the edge of concentric spiral has to be the surface with a smallest angle of deviation of the emerging axis (a) of penetrable slit 3. It is also the surface that is nearest to emerging axis when compared with other surface surround emerging axis (a).

Fluid with a certain pressure is forced to penetrate through the penetrable slit 3 (shown in FIG. 3D), to the upper part of transmission base 1, wherein the fluid flow is deflected and induces fluid on transmission base 1 to flow along the swirling flow creating surface 2, which is the area that is difficult to flow through and induce fluid to flow attaching to swirling flow creating surface 2 by swirling fluid flow 2.

Swirling flow creating surface 2 is a set of surfaces that are designed to surround a center of transmission base 1 for inducing swirling flow of fluid on the horizontal plane of transmission base which is in round flat shape.

Figure 3A:
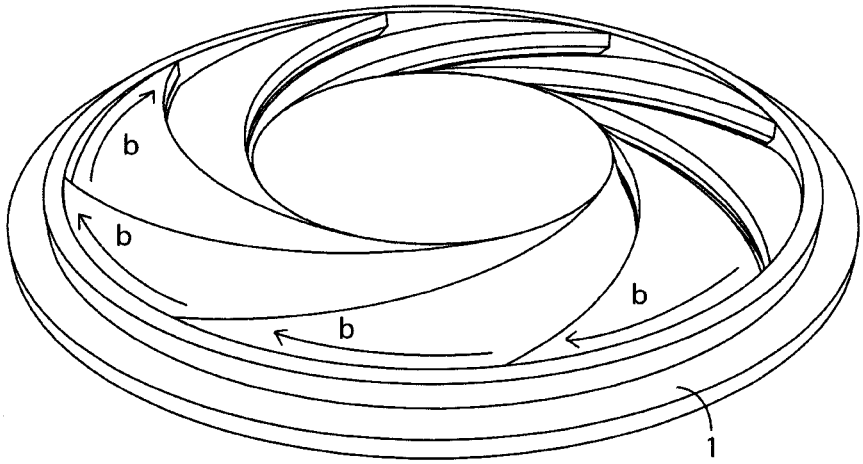
FIG. 3A, shows an apparatus for creating a swirling flow of fluid on a horizontal plane of a type of concentric spiral contour design.
Figure 3B:
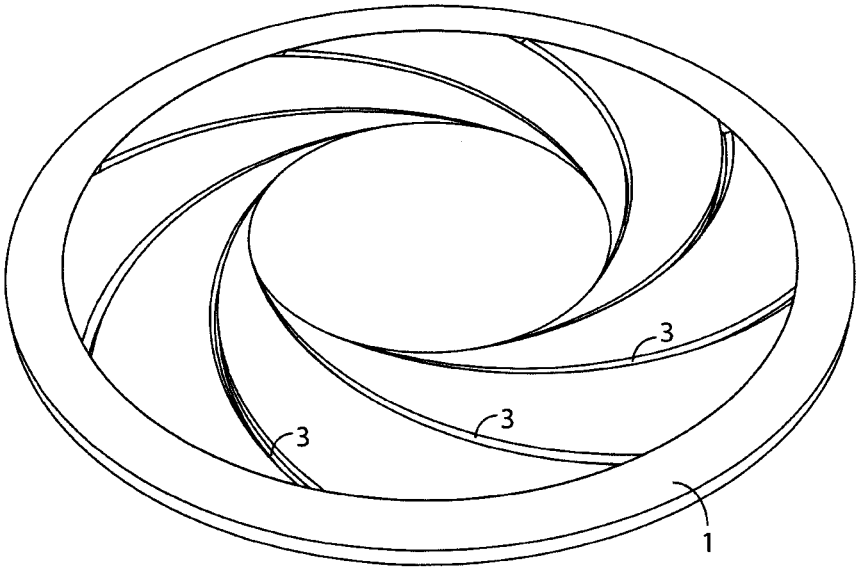
FIG. 3B, shows an underpart of the apparatus for creating a swirling flow of fluid on the horizontal plane of the type of concentric spiral contour design.
Figure 3C:
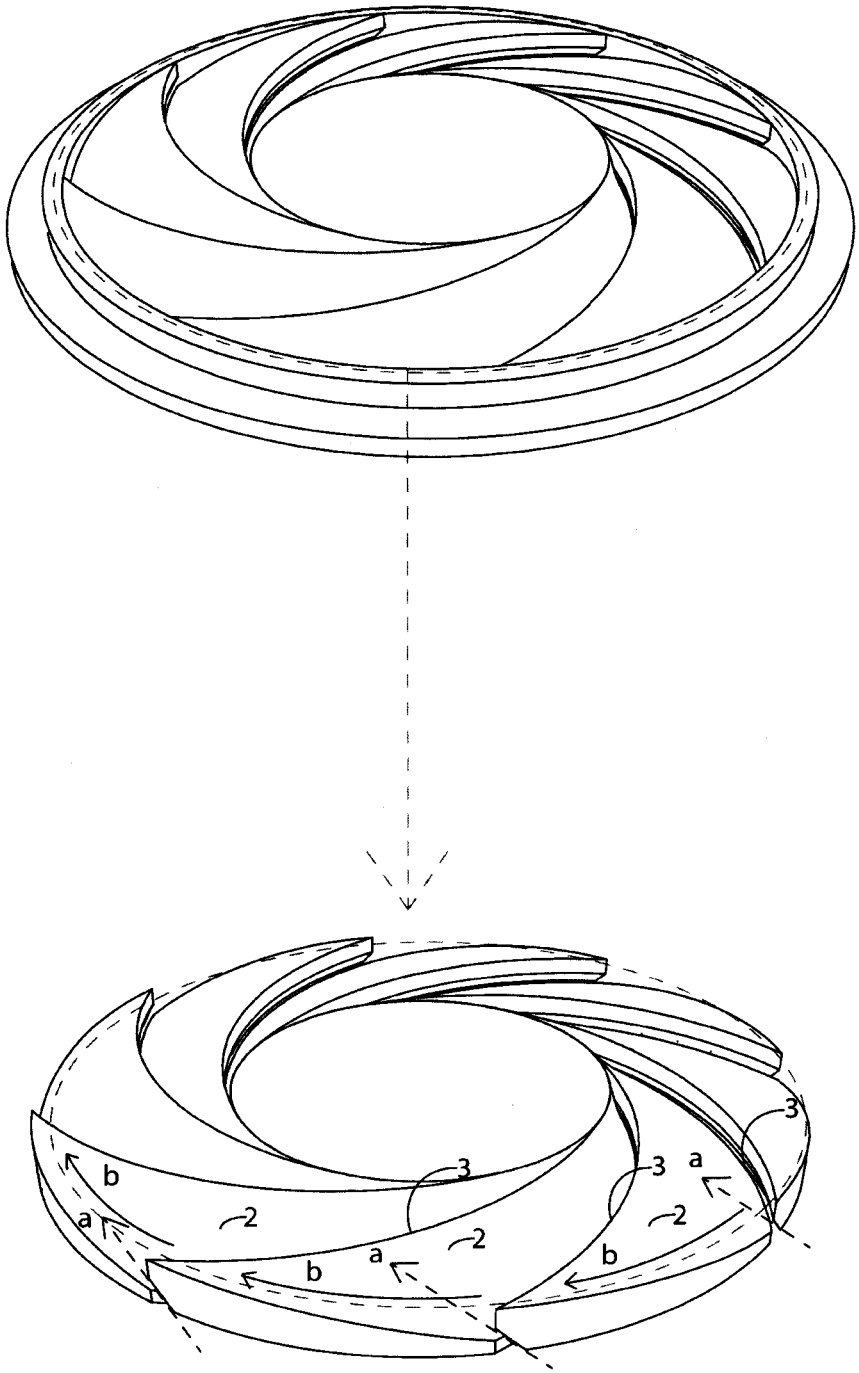
FIG. 3C, shows an upper view of the apparatus for creating a swirling flow of fluid on the horizontal plane of the type of concentric spiral contour design and shows the configuration of the concentric spiral surface for swirling flow creation and its penetrable slit.
Figure 3D:
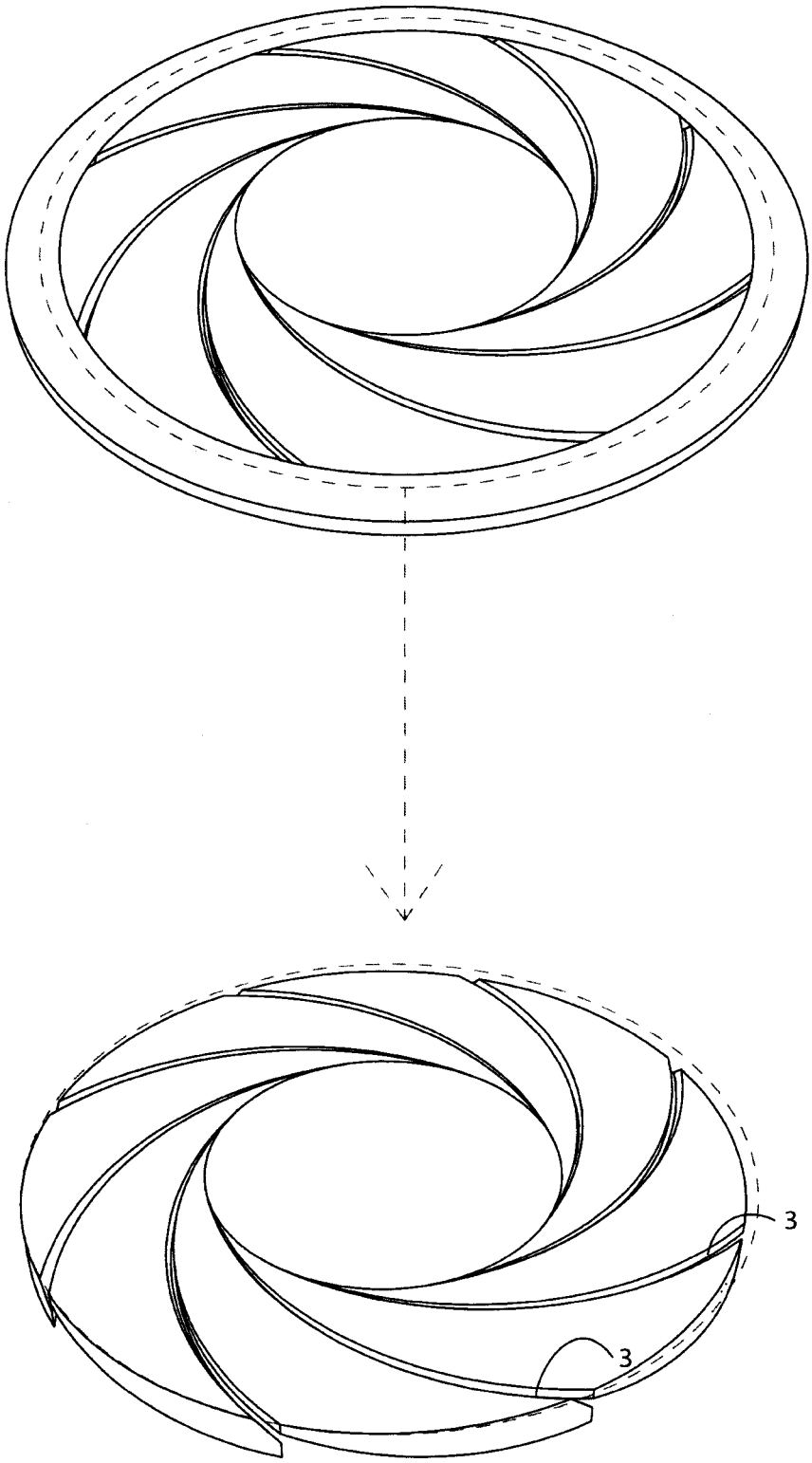
FIG. 3D, shows an underpart of the apparatus for creating a swirling flow of fluid on the horizontal plane of the type of concentric spiral contour design and a configuration of the penetrable slit.
Figure 3E:
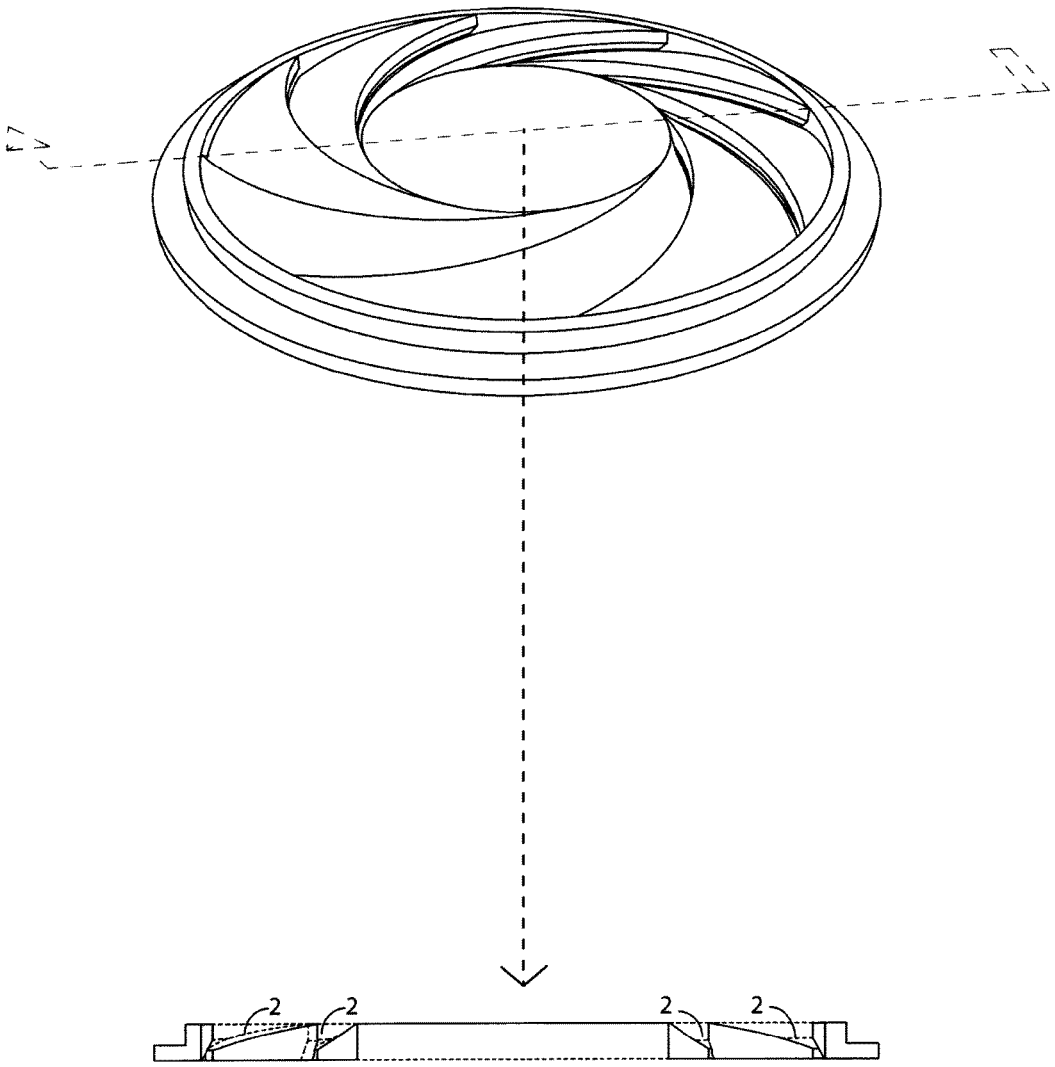
FIG. 3E, shows a vertical section view of the apparatus for creating a swirling flow of fluid on the horizontal plane of the type of concentric spiral contour design.
Figure 3F:
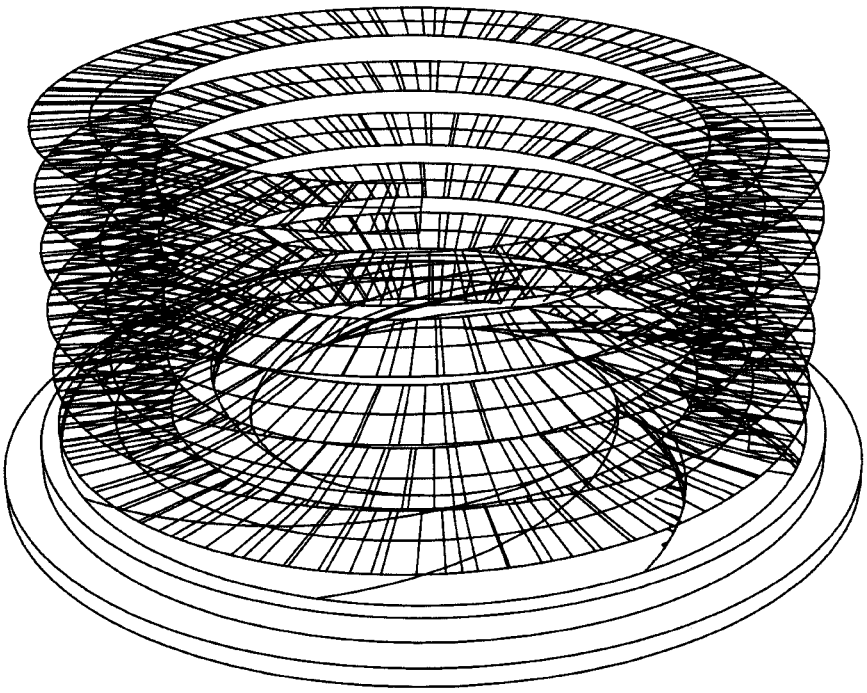
FIG. 3F, shows a laminar swirling flow of fluid in vertical to the horizontal plane of the apparatus for creating a swirling flow of fluid of the type of concentric spiral contour design.

The flow of fluid from said profile is creating the deflection and inducing of fluid upon transmission base 1 to flow attaching to the swirling flow creating surface 2 that is located around on transmission base 1 (shown in FIGS. 3A and 3C on arrow (b)). This process creates swirling flow of fluid on horizontal plane in the manner of fluid sheet in laminar swirling flow with high velocity without turbulent flow and it is swirling on vertical to the horizontal plane (shown in 3F).

From the characteristic of apparatus for creating a swirling flow of fluid on the horizontal plane of the present invention, the swirling flow creating surface is has a curvature of which the beginning section has to be the surface with a smallest angel of deviation of the emerging axis of the penetrable slit. The said curved surface is nearest to the penetrable slit when compared with other surface surround the emerging axis, for deflecting the fluid which forced by a certain pressure to flow through the penetrable slit upon the transmission base to flow attaching to the swirling flow creating surface and induce the fluid on transmission base to flow attaching to swirling flow creating surface which is the area that is difficult to flow through. All the said 3 types of swirling flow creating surfaces are designed to surround the center of transmission base for creating the swirling flow of fluid on the horizontal plane of transmission base.

The composition layout of the transmission base, the swirling flow creating surface, and the penetrable slit, in the said profile above are fixed according to the principle of Coanda profile. With such Coanda profile, the apparatus will deflect and induce fluid to flow attaching to the swirling flow creating surface which is the area that is hard to flow though. This phenomenon is called Coanda effect. Together with the profile located on the horizontal plane, it will create the swirling flow of fluid as fluid sheet with laminar swirling flow with high velocity without turbulent flow. It also has a clear distribution of centrifugal acceleration gradient on the horizontal plane of transmission base.

In case install the apparatus for creating swirling flow of fluid of the present invention on the horizontal plane, the sum of gravity force act to the mass of fluid is perpendicular to swirling flow creating surface which will promote fluid to flow attaching swirling flow creating surface, making thick boundary layers, thereby the efficiency of apparatus, especially in the case of high density and high viscosity fluid.

BEST MODE FOR CARRYING OUT THE INVENTION

As the same as described in Complete Disclosure of this Invention section.

The invention claimed is:

1. An apparatus for creating a swirling flow of fluid on a horizontal plane comprising:

a transmission base having a circular base;

a plurality of swirling flow creating surfaces located symmetrically circumscribing a central axis of the transmission base, wherein each of the plurality of swirling flow creating surfaces is curved outward to a circumferential surface contour of a cone shape, a conical frustum shape, or a concentric spiral shape about the central axis of the transmission base; and a penetrable slit in between a pair of adjacent swirling flow creating surfaces along an edge of one of the pair of adjacent swirling flow creating surfaces for transmitting fluid from an underpart of the transmission base through the penetrable slit to an upper part of the transmission base to create the swirling flow of fluid on the horizontal plane, wherein a beginning section of an individual swirling flow creating surface is nearest an axis of emergence of fluid through the penetrable slit when compare with other surface surround the penetrable slit such that the plurality of swirling flow creating surfaces creates a Coanda effect to deflect and induce fluid to flow attaching to the swirling flow creating surfaces creating the swirling flow on the horizontal plane of the transmission base.

2. The apparatus of claim 1, wherein the transmission base is a cone shape or a conical frustum shape which has an incline slope of about 10-15 degrees.

3. The apparatus of claim 1, wherein each of the plurality of penetrable slits extends along an entire side length of one of the plurality of flow creating surfaces.

4. The apparatus of claim 1, wherein the plurality of swirling flow creating surfaces circumscribing the central axis of the transmission base forms a first row of swirling flow creating surfaces, and wherein the apparatus further includes a second row of swirling flow creating surfaces adjacent the first row of swirling flow creating surfaces.

5. The apparatus of claim 1, wherein the transmission base is an annular base supporting the plurality of swirling flow creating surfaces, and wherein the annular base includes one of an annular wall or a conical wall circumscribing the plurality of swirling flow creating surfaces.

6. An apparatus for creating a swirling flow of fluid on a horizontal plane comprising:

a transmission base having a circular annular base;

a plurality of swirling flow creating surfaces located symmetrically circumscribing a central axis of the transmission base and supported by the transmission base, wherein each of the plurality of swirling flow creating surfaces is curved outward to a circumferential surface contour of a cone shape, a frustum shape, or a concentric spiral shape about the central axis of the transmission base, having a round and flat base with a thickness, wherein each of the plurality of penetrable slits extends along an entire side length of one of the plurality of flow creating surfaces, and wherein the circular annular base includes one of an annular wall or a conical wall circumscribing the plurality of swirling flow creating surfaces; and a penetrable slit in between a pair of adjacent swirling flow creating surfaces along an edge of one of the pair of adjacent swirling flow creating surfaces for transmitting fluid from an underpart of the transmission base through the penetrable slit to an upper part of the transmission base to create the swirling flow of fluid on the horizontal plane, wherein a beginning section of an individual swirling flow creating surface is nearest an axis of emergence of fluid through the penetrable slit such that the plurality of swirling flow creating surfaces creates a Coanda effect to deflect and induce fluid to flow creating the swirling flow on the horizontal plane.

7. The apparatus of claim 6, wherein the plurality of swirling flow creating surfaces circumscribing the central axis of the transmission base forms a first row of swirling flow creating surfaces, and wherein the apparatus further includes a second row of swirling flow creating surfaces adjacent the first row of swirling flow creating surfaces.

* * * * *